US006325369B1

(12) United States Patent
Strutt

(10) Patent No.: US 6,325,369 B1
(45) Date of Patent: Dec. 4, 2001

(54) SHEET FEEDING APPARATUS

(75) Inventor: John R. Strutt, Shefford (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/407,123

(22) Filed: Sep. 27, 1999

(30) Foreign Application Priority Data

Sep. 30, 1998 (GB) ..... 9821216

(51) Int. Cl.[7] ..... B65H 3/44; B65H 5/26

(52) U.S. Cl. ..... 271/9.02; 271/9.11; 271/9.12; 271/276

(58) Field of Search ..... 271/9.07, 9.02, 271/9.04, 9.11, 9.12, 9.13, 276

(56) References Cited

U.S. PATENT DOCUMENTS

| | | | | |
|---|---|---|---|---|
| 3,304,080 | * | 2/1967 | Greenblott et al. | 271/9.11 |
| 4,089,515 | * | 5/1978 | Strange et al. | 271/276 |
| 4,141,545 | | 2/1979 | Schnall et al. | 271/118 |
| 4,513,956 | * | 4/1985 | Sigvardt et al. | 271/9.11 |
| 4,674,734 | * | 6/1987 | Ibuchi | 271/9.11 |
| 4,770,403 | * | 9/1988 | Ratsumata et al. | 271/9.07 |
| 5,146,286 | | 9/1992 | Rees et al. | 355/309 |
| 5,192,066 | * | 3/1993 | Steinhilber | 271/10.1 |
| 5,709,377 | * | 1/1998 | Yoshioka et al. | 271/9.05 |
| 5,921,544 | * | 7/1999 | Benedict | 271/276 |

FOREIGN PATENT DOCUMENTS

| | | | | |
|---|---|---|---|---|
| 362100335A | * | 5/1987 | (JP) | 271/9.12 |
| 403216453A | * | 9/1991 | (JP) | 271/276 |
| 404308146A | * | 10/1992 | (JP) | 271/9.13 |

* cited by examiner

*Primary Examiner*—H. Grant Skaggs

(57) ABSTRACT

The present invention relates to a sheet feeding apparatus for delivery of sheets from multiple sheet stores. The sheet feeding apparatus comprises a sheet feed member such as an endless belt having a plurality of movable sheet receiving surfaces. A plurality of sheet transfer mechanisms move sheets from the sheet stores, which may be stationary, onto the receiving surfaces. Once on the receiving surfaces, the sheets are transported toward a common delivery position such as the entrance to the common paper path of a reprographic print engine.

11 Claims, 4 Drawing Sheets

SHEET FEEDING APPARATUS

Priority is claimed under United Kingdom Application No. 9821216.0 entitled "Sheet Feed Assembly" filed on Sep. 30, 1998 by the same inventor.

FIELD OF THE INVENTION

The invention relates to a sheet feeding apparatus, particularly for use in printing machines such as copiers and printers.

BACKGROUND OF THE INVENTION

In a typical sheet-fed printing machine, blank sheets are provided in a store and are fed singly from the store to a printing station where an image is transferred onto the paper in a conventional manner. The imaged sheet is then fed to an output station. An example of a typical reprographic printing machine is described in U.S. Pat, No. 5,146,286 which describes a particularly compact architecture in which the functions of copy sheet feeding and stacking are combined into one apparatus. Another example of a reprographic printing machine is described in U.S. Pat. No. 4,141,545.

There is a continuing need to enable images to be reproduced on sheets of different type. In simple reprographic machines this requires that prior to the printing operation, a sheet of the particular type required is loaded into the sheet store for feeding to the copying station. More sophisticated reprographic machines include a number of sheet stores enabling sheets to be drawn from a selected one of those stores depending upon the type of sheet required. In a simple example, the different type of sheet may comprise sheets of different sizes, for example A4 and A3. At present, relatively complex sheet feeding apparatuses are needed to convey sheets from the different stores to the copying/printing station.

SUMMARY OF THE INVENTION

In accordance with one aspect of the present invention, a sheet feeding apparatus for delivering sheets from a plurality of sheet stores to a common delivery position comprises (1) a sheet feed member having a plurality of movably mounted receiving surfaces positioned in opposing directions for receiving a sheet and for moving the sheet toward the common delivery position and (2) a plurality of sheet transfer mechanisms for transferring sheets from the sheet stores to the receiving surfaces, each transfer mechanism being positioned to feed a receiving surface.

BRIEF DESCRIPTION OF THE DRAWINGS

Other aspects of the present invention will become apparent as the following description proceeds and upon reference to the drawings, in which.

DETAILED DESCRIPTION OF THE INVENTION

While the present invention will hereinafter be described in connection with its preferred embodiments, it will be understood that it is not intended to limit the invention to these embodiments. On the contrary, the following description is intended to cover all alternatives, modifications, and equivalents, as may be included within the spirit and scope of the invention as defined by the appended claims.

Although the present invention is particularly well adapted for use in a reprographic printing machine using technology similar the technology disclosed in U.S. Pat. No. 5,146,286 and U.S. Pat. No. 4,141,545, referred to above and incorporated by reference, it will become apparent from the following discussion that the sheet feeding apparatus of the present invention is equally well suited for use in a wide variety of reprographic as well as many other printing systems. For example, it may be used in ink-jet printing machines is and electrostatographic printing machines, amongst others.

Figure 1:
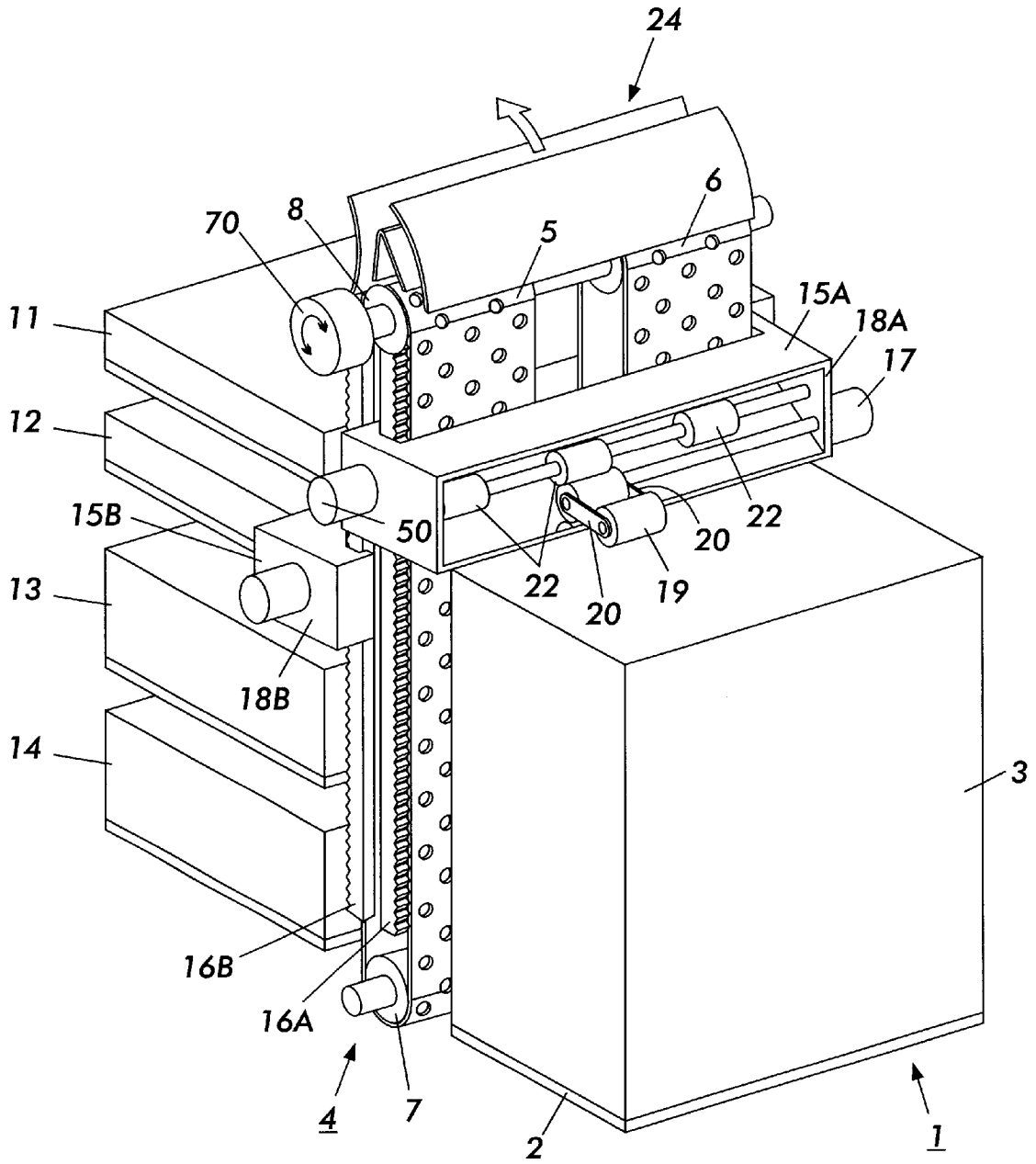
FIG. 1 is a schematic, perspective view showing a sheet feeding apparatus incorporating the features of the present invention therein.

With respect to the particular features of the sheet feeding apparatus of the present invention, reference is made to FIG. 1, wherein a sheet feeding apparatus is shown that comprises a high capacity sheet store 1 defined by a stationary support tray 2 on which a paper stack 3 is positioned in use. The sheet store 1 is provided adjacent to a vertically oriented vacuum feed system 4 comprising a sheet feed member having movably mounted receiving surfaces for receiving sheets and for moving the sheets toward a common delivery position 24. As shown in FIG. 1, each receiving surface preferably comprises a pair of endless belts 5 and 6. Although the belt assembly could be provided with a high friction surface for feeding the sheets, preferably it forms part of a vacuum feed system. Such systems are relatively cheap to implement and yet can achieve reliable feeding. Accordingly, endless belts 5, 6 are each shown as perforated and extending between an idler roller 7 and a vertically spaced drive roller 8 connected to a drive motor 70. The perforations in the belts 5, 6 communicate with a pair of vacuum chambers (Shown in FIG. 4), each of which communicates with a vacuum pump (not shown). In an alternate embodiment, the sheet feed member could comprise one or more rotatably mounted rollers, particularly friction rollers.

On the opposite side of the transport 4 from the store 1 is provided a number of additional stores 11–14 which are vertically spaced one above the other and comprise respective trays (as shown). Each store 11–14 has a capacity smaller than store 1.

In order to feed sheets from the stores 1, 11–14 to the feed system 4, a pair of vertically movable sheet transfer mechanisms comprising feed heads 15A; 15B are provided, each supported on a pair of laterally spaced racks 16A, 16B (only one of each shown in FIG. 1), each rack cooperating with a pinion (not shown) located within the respective feed head 15A, 15B and coupled with a respective elevator motor 50 secured to a main body 18A, 18B of the feed head. The elevator motor 50 of the feed head 15A is shown in FIGS. 1 and 2.

If, as shown, at least two stores are vertically spaced from one another, each store may cooperate with a single sheet transfer mechanism to enable the topmost sheet of a selected store to be fed to the sheet feed member. Although a separate sheet transfer mechanism could be associated with each store, a single sheet transfer member may conveniently be used which can be moved from one store to another. This simplifies the overall construction of the assembly.

Figure 2:
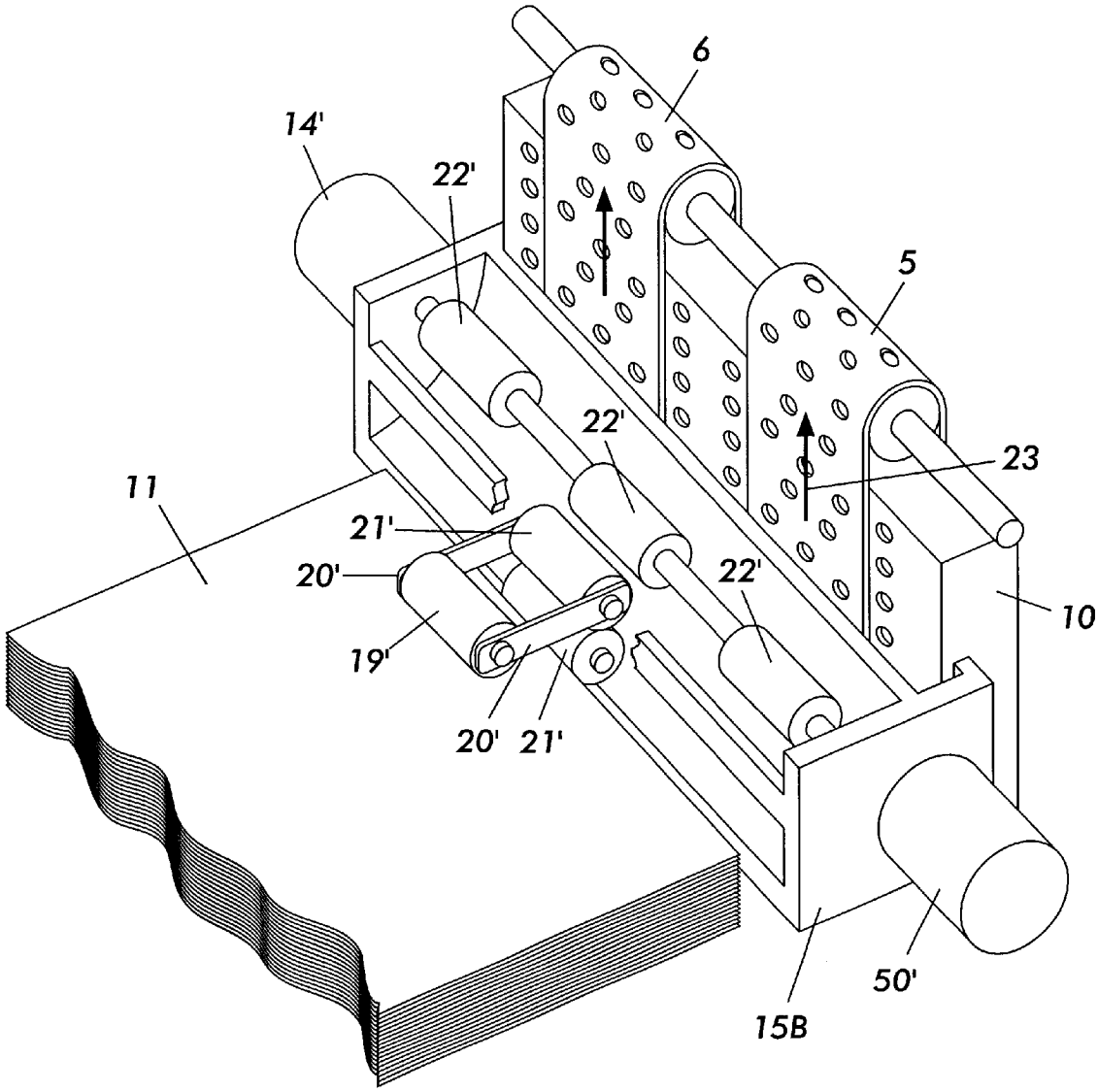
FIG. 2 is a schematic, perspective view showing a portion of the FIG. 1 sheet feeding apparatus.

As shown in FIGS. 1 and 2, the feed head 15A also includes a nudger member comprising, in a preferred embodiment, a roll 19 mounted between a pair of arms 20 extending from the main body 18A. The nudger roll 19 is rotated in a clockwise direction (as seen in FIG. 2) by a feeder drive, stepper motor 17 to draw the topmost sheet in the stack towards the feed head 15A and between a further pair of separator rollers 21 (only one shown in FIG. 1) defining a sheet feed nip. The upper separator roll 21 is driven in the process direction and the lower in an anti-process direction via a friction clutch. This clutch is set so that the friction of a single sheet of paper being fed by the top separator roll 21 will override the clutch to allow the lower roll to be driven by the paper and thereby rotate in the process direction. Should there be more than one sheet of paper between these two rolls, the clutch friction is sufficiently higher than that of the friction of paper to paper so that the lower sheet is driven in the anti-process direction. A sheet passing through the nip defined between the rollers 21 is then fed under rollers 22 (driven by the motor 17) in the feed head 15A into engagement with the belts 5, 6.

Figure 4:
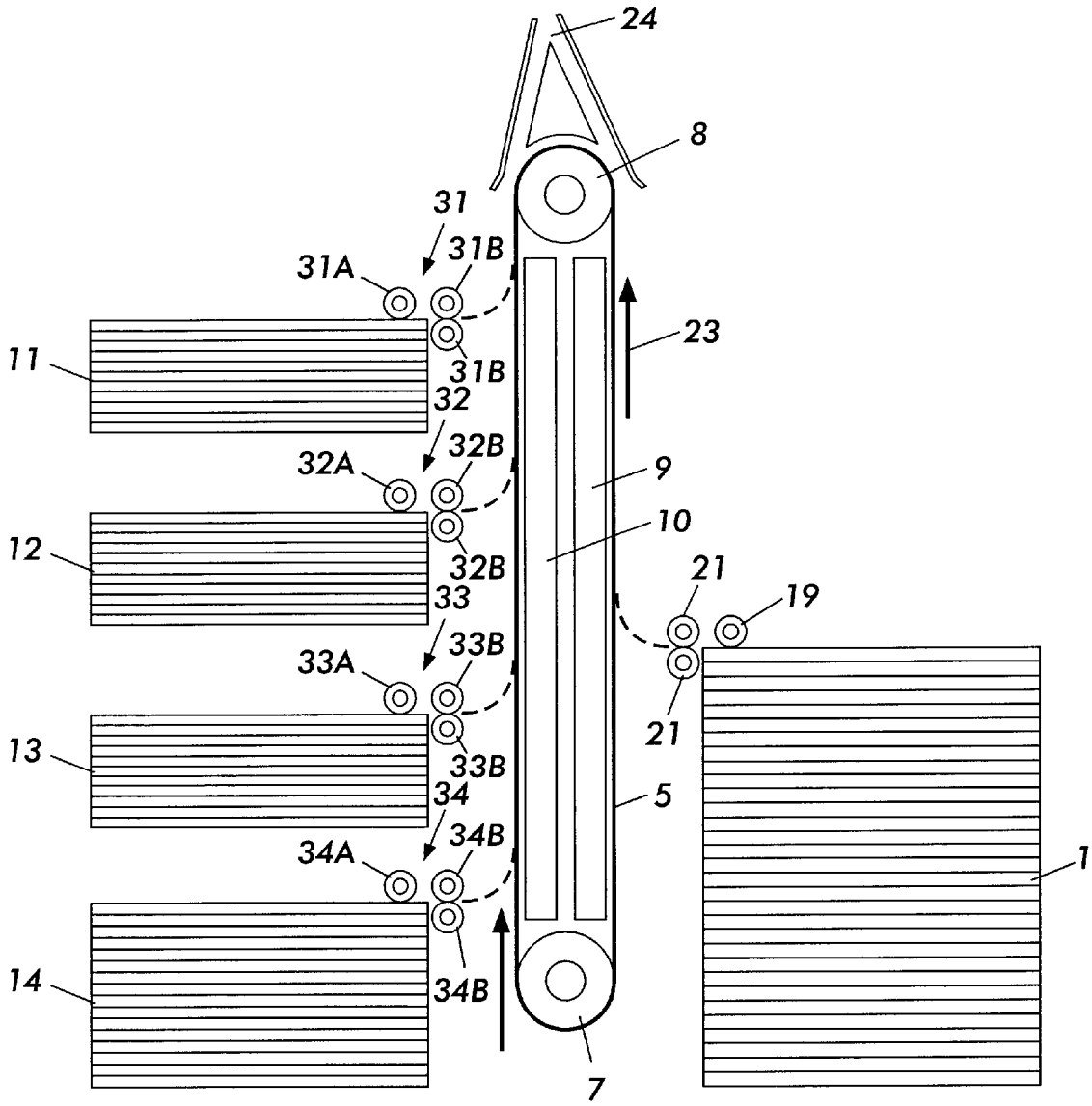

The belts 5,6 are rotated in the direction indicated by arrow 23 (FIG. 2) so that the sheet is conveyed vertically upwardly into a paper path 24 constituting a common delivery position. The common delivery position could comprise a further sheet feeding apparatus, an outlet station, a copying position or the like depending upon the apparatus into which the sheet feed assembly is incorporated. The common delivery position shown in FIGS. 1 and 4 is formed by a plenum having multiple apertures for receiving sheets from the different sheet receiving surfaces. The plenum guides the sheets into a common delivery position for onward feeding in a conventional manner to an imaging station.

As shown in FIG. 1, the nudger roll 19 also acts to detect the top of the paper stack 3 in a conventional manner and is connected to sensing equipment (not shown) so that as the feed head 15A is lowered towards the paper stack 3 by the elevator motor 50. Engagement of the nudger roll 19 with the stack 3 is detected, causing the motor 50 to terminate its action.

The feed head 15B has a similar construction to the head 15A and so the same reference numerals are used to illustrate similar parts but with the addition of a prime (see FIG. 2). The vertical location of the head 15B is determined using the rack 16B and pinion (not shown in FIG. 2) although this could be replaced by elevation cables attached to upper rollers which are rotated to cause the feed head to take up the desired vertical position. As can be seen in FIG. 2, the head 15B is positioned to feed sheets from the store 11 with the nudger roller 19' in contact with the top most sheet. FIG. 2 also shows a vacuum chamber 10 associated with the head 15B.

Figure 3:
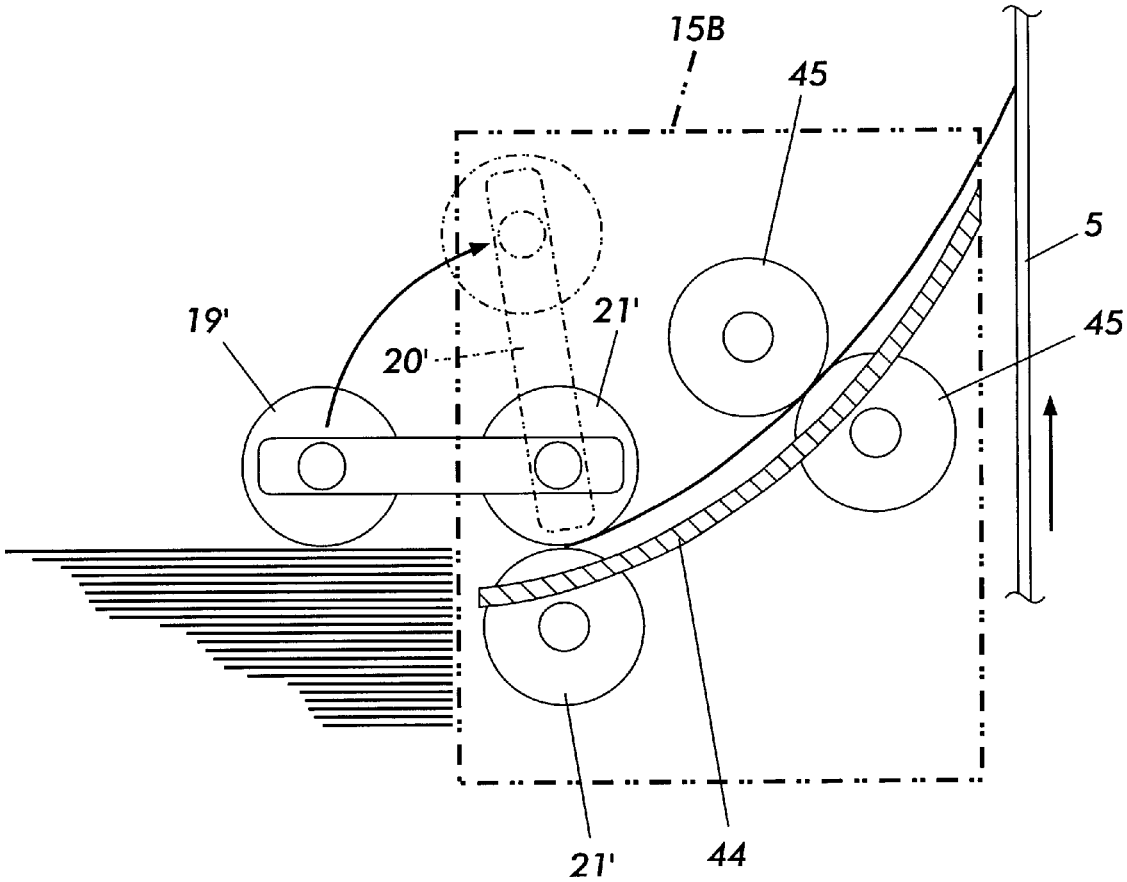
FIG. 3 is a schematic elevational view of FIG. 3 sheet feeding apparatus; and, FIG. 4 is a schematic elevational view showing a modified version of the FIG. 1 sheet feeding apparatus.

If it is desired to withdraw a sheet from one of the lower stores 12–14, the arms 20 are pivoted about their inner axis by a motor or solenoid (not shown) causing the nudger roller 19 to move to its retracted position as shown in FIG. 3 at 43. The head 15B is then lowered to bring it into line with the appropriate store and the arms 20 are then pivoted back to the extended position with the nudger roller 19 engaging the top most sheet of the selected store. One or more sheets can then be withdrawn from that store as before.

Although each of stores 1, 11–14 can be movably mounted, stationary stores are preferred since this enables the stores to have much higher capacity. A typical 2.5K paper stack weighs approximately 12 kilograms and so would require a strong motor using considerable power to drive the sheet store into engagement with the sheet transfer means. However, much less power is needed to move the sheet transfer means into contact with the topmost sheet of a store. Of course, a mixture of stationary and movable stores could also be used.

As can be seen in FIG. 3, a sheet which has been withdrawn passes through the nip between the rollers 21 and is then guided by a guide 44 via drive rolls 45 to the vacuum drive belts 5, 6.

Instead of providing a single feed head 15B, separate auxiliary feed heads 31–34 could be provided as shown in FIG. 4. Each auxiliary feed head 31–34 is associated with each of the stores 11–14, each feed head having a nudger roll 31A–34A in contact with the topmost sheet of the appropriate sheet store. When a sheet is required, the appropriate feed head 31–34 is actuated so that the nudger roll 31A–34A nudges the topmost sheet into a nip between rollers 31B–34B respectively which feed the sheet towards the vacuum feed system 4. The belts 5, 6 are rotated in the opposite direction by reversible drive motor 70 so that once again the withdrawn sheet is fed upwardly to the outlet 24. In this case, both vacuum chambers 9, 10 can be seen.

In review, the sheet feeding apparatus of the present invention includes a sheet feed member having a plurality of movably mounted sheet receiving surfaces for receiving a sheet and for moving the sheet toward a common delivery position and a plurality of sheet transfer mechanisms for transferring sheets from the sheet stores to the sheet receiving surfaces. When compared to sheet feed mechanisms of the prior art, the present invention offers a more compact sheet feeding apparatus. In its preferred embodiment, a single sheet feed member can be used to feed sheets from more than one store by moving the sheet receiving surfaces in one of two opposite directions. Each sheet store may be fixedly mounted, with a single sheet transfer mechanism being movable into engagement with the topmost sheet of each store. The described preferred embodiment is simpler than known sheet feed assemblies and considerably less costly. Also, in a preferred embodiment in which the sheet stores are stationary, much less power is required since less power is required to move a sheet transfer mechanism than to move sheet stores. Furthermore, there will also be considerable space saving over the use of individual sheet transfer mechanisms.

It is, therefore, evident that there has been provided, in accordance with the present invention, a sheet feeding apparatus that fully satisfies the aims and advantages hereinbefore set forth. While this invention has been described in conjunction with several embodiments, it is evident that many alternatives, modifications, and variations will be apparent to those skilled in the art. Accordingly, it is intended to embrace all such alternatives, modifications and variations as fall within the spirit and broad scope of the appended claims.

What is claimed is:

1. A sheet feeding apparatus for delivering sheets from a plurality of sheet stores to a common delivery position, comprising:

a) a sheet feed member having a plurality of movably mounted receiving surfaces positioned in opposing directions for receiving a sheet and for moving the sheet toward the common delivery position;

b) a plurality of sheet transfer mechanisms for transferring sheets from the sheet stores to the receiving surfaces, each transfer mechanism being positioned to feed a receiving surface; and c) a plurality of sheet stores adjacent to at least one receiving surface.

2. The sheet feeding apparatus of claim 1, wherein a sheet transfer mechanism is movably mounted for engagement with a plurality of sheet stores.

3. The sheet feeding apparatus of claim 2, further comprising a movably mounted nudger member wherein the nudger member retracts during movement of the sheet transfer mechanism.

4. The sheet feeding apparatus of claim 1, wherein the receiving surfaces are capable of reversible motion for movement of the sheet toward the common delivery position.

5. The sheet feeding apparatus of claim 1, further comprising a reversible drive mechanism operatively linked with the sheet feed member for driving motion of a receiving surface toward the common delivery position.

6. The sheet feeding apparatus of claim 1, wherein the sheet feed member is mounted substantially vertically.

7. The sheet feeding apparatus of claim 1, wherein the sheet feed member comprises a rotatably mounted endless belt.

8. The sheet feeding apparatus of claim 1, further comprising a vacuum system cooperating with the sheet feed member during movement of the sheet toward the common delivery position.

9. The sheet feeding apparatus of claim 1, wherein a sheet store is mounted in a substantially stationary position.

10. The sheet feeding apparatus of claim 9, wherein at least one sheet transfer mechanism is movably mounted and moves for engagement with sheets in the stationary sheet store.

11. The sheet feeding apparatus of claim 1, wherein the common delivery position comprises a plenum having a plurality of apertures, each aperture being positioned to receive sheets from a receiving-surface.

* * * * *